US006911882B2

(12) United States Patent
Haruta et al.

(10) Patent No.: US 6,911,882 B2
(45) Date of Patent: Jun. 28, 2005

(54) HIGH-FREQUENCY MODULE, TRANSMITTER-RECEIVER, AND METHOD OF ADJUSTING CHARACTERISTIC OF THE HIGH-FREQUENCY MODULE

(75) Inventors: Kazumasa Haruta, Kanazawa (JP); Takehisa Kajikawa, Nishinomiya (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 96 days.

(21) Appl. No.: 10/465,543

(22) Filed: Jun. 20, 2003

(65) Prior Publication Data

US 2003/0234695 A1 Dec. 25, 2003

(30) Foreign Application Priority Data

Jun. 24, 2002 (JP) ..... 2002-183202

(51) Int. Cl.[7] ..... H01P 7/00

(52) U.S. Cl. ..... 333/235; 333/202; 333/219; 331/96

(58) Field of Search ..... 333/202, 205, 333/207, 209, 210, 219.1, 235; 331/68, 96, 97, 99, 107 DP

(56) References Cited

U.S. PATENT DOCUMENTS 2,856,589 A 10/1958 Kazan
4,639,690 A * 1/1987 Lewis ..... 331/96
5,220,300 A * 6/1993 Snyder ..... 333/210
5,990,752 A * 11/1999 Papazian et al. ..... 331/96
6,163,688 A * 12/2000 Fujii et al. ..... 331/68
6,172,572 B1 * 1/2001 Kajikawa et al. ..... 331/96
6,388,535 B1 * 5/2002 Otsuki et al. ..... 331/177 R
2002/0044022 A1 4/2002 Shintani et al.

FOREIGN PATENT DOCUMENTS

EP 0 499 643 A1 8/1992
GB 1 590 320 5/1981
JP 05-129810 5/1993
JP 05-129812 5/1993
JP 11017417 A * 1/1999 ..... H01P/7/10
JP 2001-292028 10/2001
WO WO 200284787 A1 * 10/2002 ..... H01P/7/00

OTHER PUBLICATIONS

Abstract of JP 05315820.

* cited by examiner

*Primary Examiner*—Seungsook Ham
(74) *Attorney, Agent, or Firm*—Dickstein, Shapiro, Morin & Oshinsky, LLP.

(57) ABSTRACT

A high-frequency module includes a dielectric plate in which a resonator is formed and a cover for covering the dielectric plate. A hole is provided in the cover. A laser beam for laser trimming passes through the hole. The area of opening and the depth of the hole are defined so that electromagnetic waves in a usable frequency band are cut off in the hole. An electrical characteristic is measured in a state where all components including the cover are assembled, and laser trimming is performed through the hole so as to obtain a desired characteristic.

10 Claims, 11 Drawing Sheets

HIGH-FREQUENCY MODULE, TRANSMITTER-RECEIVER, AND METHOD OF ADJUSTING CHARACTERISTIC OF THE HIGH-FREQUENCY MODULE

BACKGROUND OF THE INVENTION

1. Field of the Invention

The present invention relates to a high-frequency module used in a microwave band or a millimeter wave band, such as a resonator, a filter, or an oscillator, and to a method of adjusting the characteristic thereof and a transmitter-receiver including the high-frequency module.

2. Description of the Related Art

Each of the following references: (1) Japanese Unexamined Patent Application Publication No. 5-129810, (2) Japanese Unexamined Patent Application Publication No. 5-129812, and (3) Japanese Unexamined Patent Application Publication No. 2001-292028 discloses a high-frequency module whose electrical characteristic is adjusted by trimming.

In (1), resonance frequency is adjusted by forming a through hole or a non-through hole in a resonator so that a laser beam is radiated thereto, or by removing a ground plane, a dielectric portion, and a central conductor by sandblasting.

In (2), a window of a metallic substrate is open in the back side of a sub-strip line such that the entire microstrip line is exposed. In this configuration, the resonance frequency of a dielectric resonator element is changed by removing the back surface of the microstrip line through that window.

In (3), frequency is adjusted in the following way in a voltage-controlled oscillator. That is, a microstrip line resonator is formed on a dielectric substrate and a case is attached on the dielectric substrate. Then, a laser beam is radiated to the back surface of the dielectric substrate so as to trim a strip electrode.

In (1) and (2), the size of the hole and window used for adjustment is not limited. Therefore, in a high-frequency band, such as a millimeter wave band, the module may be externally affected significantly. Also, since the output of a signal leaks out, entire power efficiency may be reduced.

In the adjustment method of (3), the strip electrode to be trimmed cannot be seen directly. Thus, it is very difficult to adjust the amount of trimming in a high-frequency module of a millimeter wave band.

SUMMARY OF THE INVENTION

An object of the present invention is to overcome the above-described problems and to provide a high-frequency module in which external influences can be avoided, power efficiency does not decrease, and a slight adjustment of characteristic can be easily performed, and a method of adjusting the characteristic thereof and a transmitter-receiver.

A high-frequency module of the present invention includes an element substrate having a dielectric or insulating substrate provided with a conductive film; and a conductive cover for covering the element substrate. Also, a hole is formed in the cover, the hole allowing a laser beam for laser trimming to pass therethrough to the element substrate, and the area of opening and the depth of the hole being defined so that electromagnetic waves in a usable frequency are cut off in the hole.

With this configuration, laser trimming can be performed in a state where the cover for covering the element substrate is attached. Accordingly, an inconvenient process, in which adjustment is performed by laser trimming before attaching the cover and then the cover is attached so as to measure the characteristic, need not be conducted. Thus, the characteristic can be adjusted with a good reproducibility in the present invention. Furthermore, the hole, through which a laser beam for laser trimming passes, cuts off electromagnetic waves in a usable frequency. Therefore, a high-frequency module which is not externally affected and which does not generate radiation to the outside can be obtained.

Also, the hole is formed so as to extend in a direction substantially parallel to the direction of a current flowing through the cover. With this arrangement, the hole can be formed in a relatively wide range without having a bad effect on the path of current flowing through the cover, and thus laser trimming can be easily performed.

Further, the area of the opening of the hole is changed in accordance with the hole depth, so that the laser beam can be radiated to the element substrate at an angle. With this arrangement, even if the hole has a small opening, a laser beam can be radiated over a wide range of the element substrate.

Additionally, another hole is provided for the removal of unnecessary matter generated by laser-trimming a predetermined portion of the element substrate, the area of opening and the depth of the another hole being defined so that electromagnetic waves in the usable frequency are cut off in the hole. Accordingly, unnecessary matter does not remain inside the high-frequency module covered by the cover and does not adhere to the element substrate.

Further, a resonator is formed in the element substrate, the resonator including the substrate and the conductive film, and an oscillator is formed by coupling a negative resistor element to the resonator. Accordingly, an oscillation frequency characteristic can be easily adjusted, and thus a high-frequency module functioning as an oscillator in which variation in the oscillation frequency characteristic is small can be obtained.

A transmitter-receiver of the present invention includes the above-described high-frequency module serving as an oscillator; a transmitter circuit for transmitting an oscillation signal thereof; and a circuit for converting a reception signal to an intermediate frequency signal.

Accordingly, a transmitter-receiver module having a precisely-adjustable oscillator and a small variation in characteristics can be obtained.

DESCRIPTION OF THE PREFERRED EMBODIMENTS

Hereinafter, a dielectric filter according to a first embodiment will be described with reference to FIG. 1.

Figure 1:
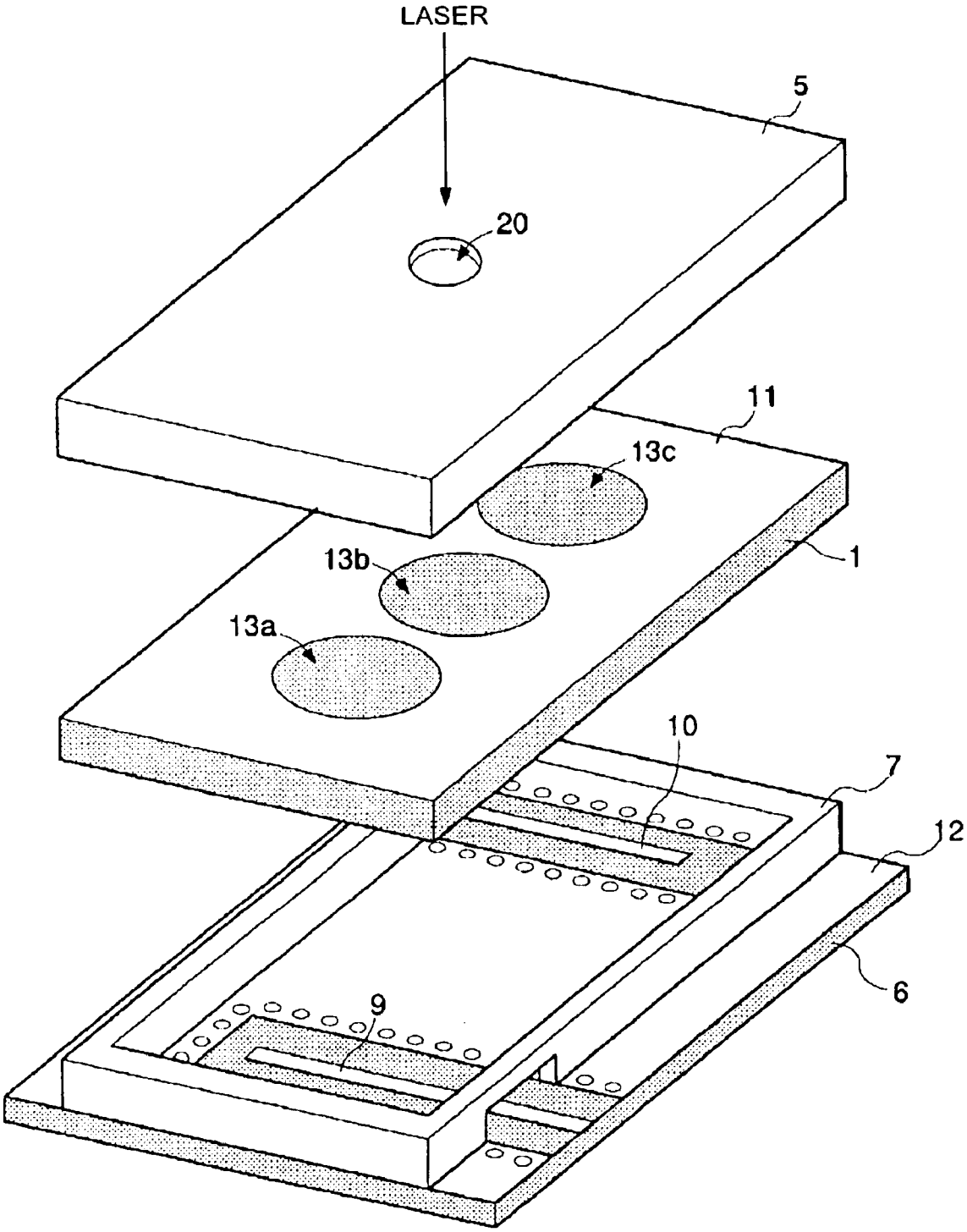
FIG. 1 is an exploded perspective view of a dielectric filter according to a first embodiment.

FIG. 1 is an exploded perspective view of the dielectric filter. The dielectric filter includes a dielectric plate 1, preferably having a thickness of 1.0 mm and a relative permittivity $\epsilon r$ of 30. A conductive film is formed on upper and lower surfaces of the dielectric plate 1. Reference numeral 11 denotes the conductive film formed on the upper surface. Also, circular non-conductive portions are provided in each of the upper and lower conductive films so that these portions face each other. These non-conductive portions define resonator portions 13*a,* 13*b,* and 13*c*. These resonator portions operate as dielectric resonators of a TE010 mode.

Reference numeral 6 denotes a substrate which comprises BT resin and which preferably has a thickness of 0.3 mm and a relative permittivity $\epsilon r$ of 3.5. A ground electrode is formed in the substantially entire area of the lower surface of the substrate, and a conductive film 12 is formed on a part of the upper surface thereof. Also, microstrip lines 9 and 10, a part thereof operating as a probe, are formed on the upper surface of the substrate 6. A frame 7 comprising a metallic material is bonded to the upper conductive film 12 of the substrate 6. Further, reference numeral 5 denotes a metallic cover. The periphery of this cover is bonded to the upper conductive film 11 at the periphery of the dielectric plate 1. With this configuration, the three resonators of the TE010 mode are sequentially coupled, and the microstrip lines 9 and 10 are coupled to the resonators of first and last stages, respectively.

The cover 5 is provided with a hole 20, through which a laser beam used for laser trimming passes to the upper surface of the dielectric plate 1. In this configuration, a filter characteristic can be measured in a state where all the components including the cover 5 are assembled, so as to find a required amount of trimming, and then laser trimming can be performed according to the amount. Alternatively, laser trimming can be performed while measuring the filter characteristic.

The internal diameter and the depth (thickness of the cover 5) of the hole 20 are defined so that the cutoff frequency of electromagnetic waves (depending on the internal diameter and the depth of the hole 20) is higher than a usable frequency band of this dielectric filter. Therefore, electromagnetic waves in the usable frequency band are cut off in the hole 20. Accordingly, undesired electromagnetic waves do not enter the dielectric filter, and also undesired radiation from the dielectric filter does not occur.

In the example shown in FIG. 1, among the three resonator portions 13*a* to 13*c,* the non-conductive portions of the resonator portion 13*b* in the second stage, that is, a dielectric portion of the dielectric plate 1, is laser-trimmed so as to adjust the resonance frequency of the resonator in the second stage. Accordingly, the filter characteristic is adjusted.

Next, a voltage-controlled oscillator (VCO) according to a second embodiment will be described with reference to FIGS. 2 to 5.

Figure 2:
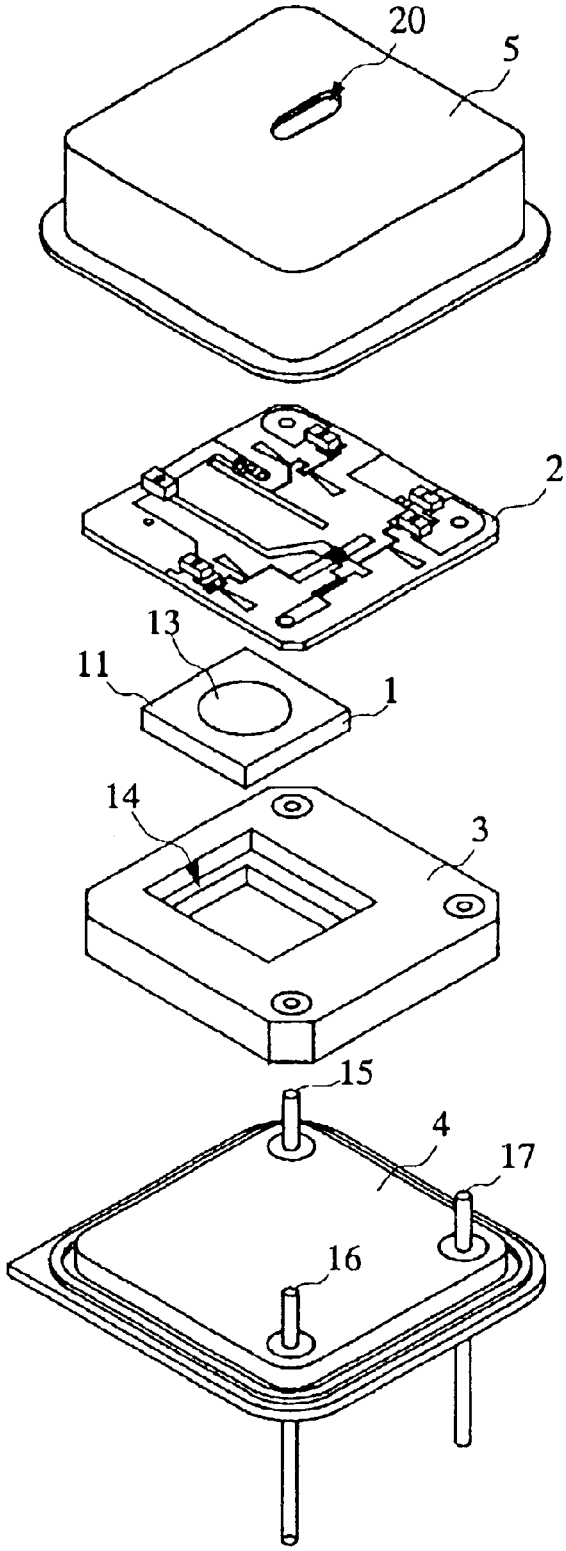
FIG. 2 is an exploded perspective view of an oscillator according to a second embodiment.

FIG. 2 is an exploded perspective view showing the entire configuration of the VCO. In FIG. 2, the VCO includes a dielectric plate 1. A conductive film 11, whose center is a circular non-conductive portion, is formed on the upper surface of the dielectric plate 1. Also, a conductive film having the same configuration as that of the conductive film 11 is formed on the lower surface of the dielectric plate 1. Accordingly, a dielectric portion is defined by the upper and lower circular non-conductive portions facing each other, and the dielectric portion serves as a resonator portion 13 of a TE010 mode.

In FIG. 2, reference numeral 2 denotes a dielectric sheet-like substrate comprising PTFE. A line coupled with the resonator portion 13 in a magnetic field is formed on the upper surface of the substrate 2. Also, reference numeral 3 denotes a metallic spacer, which includes an opening 14 to which the dielectric plate 1 is inserted. When the dielectric plate 1 is inserted into the opening 14, the upper surface of the dielectric plate 1 is flush with the upper surface of the spacer 3. In this state, by superimposing the substrate 2 onto the upper surface of the spacer 3, the dielectric plate 1 and the substrate 2 overlap at a predetermined position.

In FIG. 2, reference numeral 4 denotes a stem, to which three pins 15, 16, and 17 are provided. The spacer 3, the dielectric plate 1, and the substrate 2 are mounted on the stem 4 in this order, the pins 15, 16, and 17 are soldered to terminal electrodes provided on the substrate 2, respectively, and a cover 5 is bonded to the stem 4. Accordingly, the VCO can be obtained. The stem 4 and the cover 5 serve as a conductive case, which confines an electromagnetic field of the dielectric resonator so as to prevent radiation to the outside and coupling with the outside.

Figure 3:
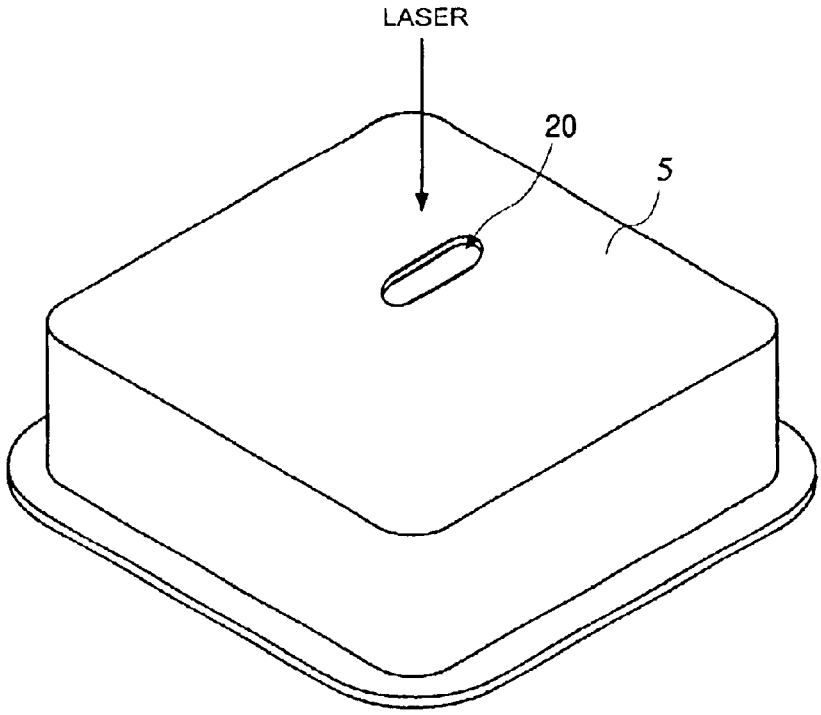
FIG. 3 is an exploded perspective view of the oscillator in which a cover is removed.
Figure 3:
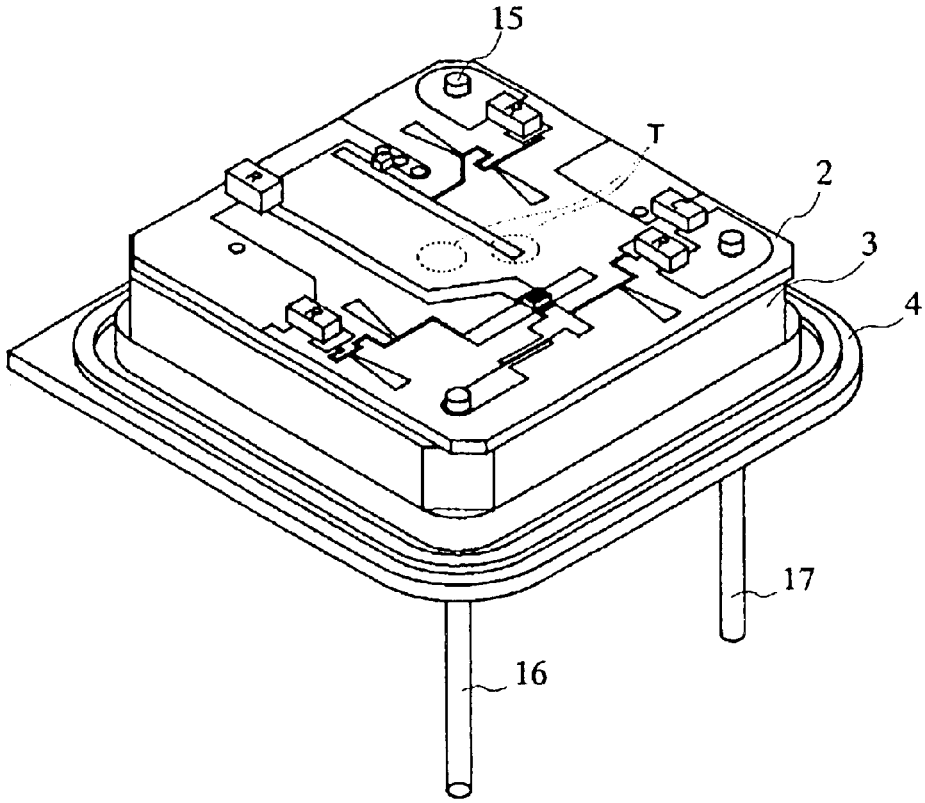
Figure 4:
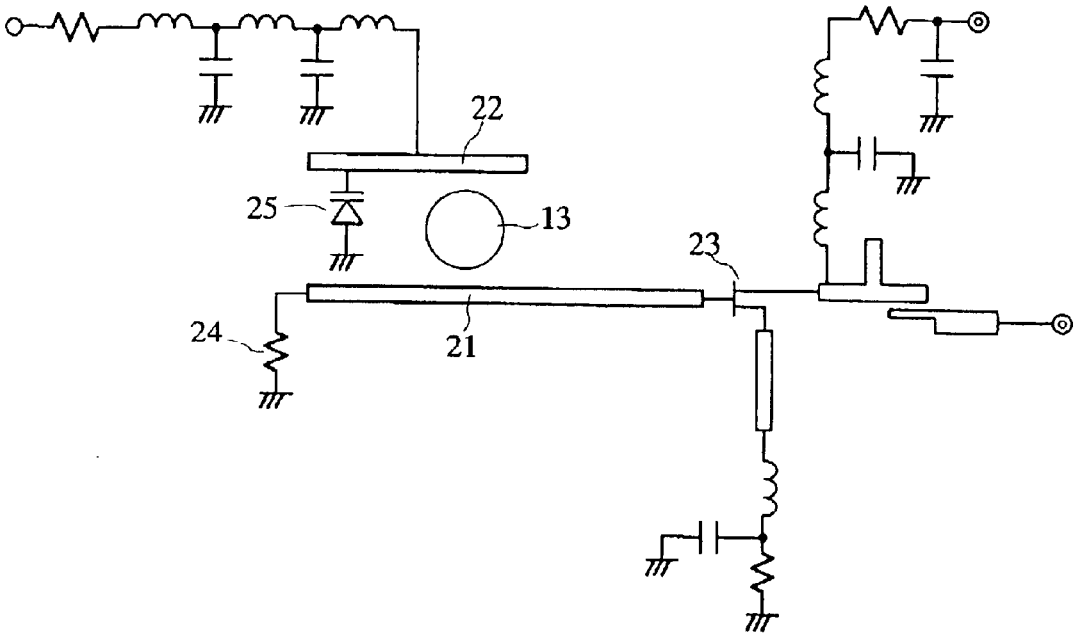
FIG. 4 is an equivalent circuit diagram of the oscillator.

FIG. 3 is a perspective view of the VCO showing a state before the cover 5 is attached, and FIG. 4 is an equivalent circuit diagram of the VCO. As shown in these figures, the resonator portion 13, a main line 21, and a FET 23 form a band-reflective oscillator, and by providing a sub line 22 coupled to the resonator portion 13 and a varactor diode 25 connected to the sub line 22, the VCO in which the oscillation frequency changes in accordance with the capacitance of the varactor diode 25 can be formed. Therefore, by changing the resonance frequency of the resonator portion 13, a change curve of the oscillation frequency with respect to a bias voltage applied to the varactor diode 25 can be shifted. Alternatively, by changing the length of the sub line 22, the change curve of the oscillation frequency with respect to a bias voltage applied to the varactor diode 25 can be shifted.

Frequency adjustment is performed in the following way.

First, in a state where the cover 5 shown in FIG. 3 is assembled, a measuring device is connected to the pins 15, 16, and 17. Then, while measuring the oscillation frequency, a laser beam is radiated to the resonator portion 13 or to the end of the sub line 22 through the hole 20, so as to perform laser trimming. Reference character T in FIG. 3 indicates laser trimming areas.

Figure 5:
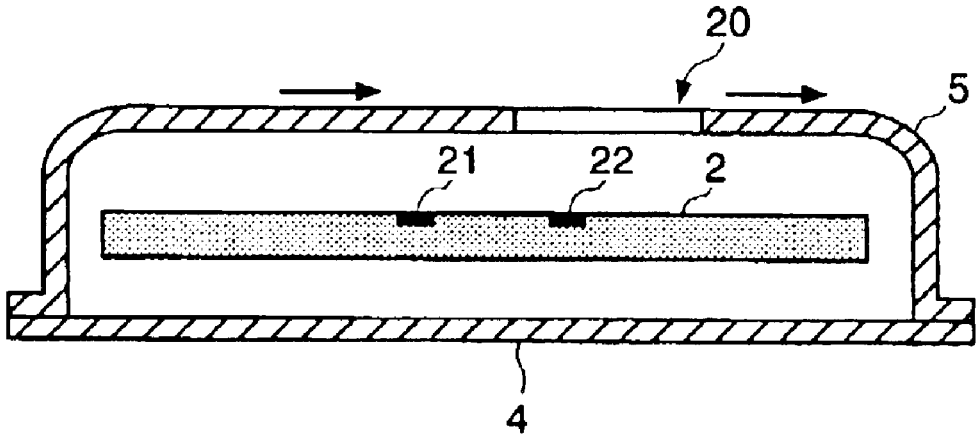
FIG. 5 is a longitudinal-sectional view showing the main part of the oscillator.

FIG. 5 shows the relationship between the direction of the main line 21 provided in the substrate 2, and the direction of a current flowing through the cover 5 and a region where the hole 20 is formed. Arrows in FIG. 5 indicate the direction of the current. As can be seen in FIG. 5, a current flows through the cover 5 in the direction substantially orthogonal to the main line 21. The hole 20 is formed so that it extends in the direction substantially parallel to the direction of the current. Accordingly, even if the hole 20 has a relatively large opening, the hole 20 has little effect on a path of the current flowing through the cover 5, and thus the hole 20 does not have a bad effect on the electrical characteristic of the VCO.

Also, the vicinity of the top of the sub line 22 is highly sensitive to adjustment of resonance frequency characteristic performed by laser trimming, and thus quantification of variation in the amount of trimming and resonance frequency can be realized. As s result, by laser-trimming the top of the sub line 22, frequency adjustment can be precisely performed over a wide range.

Next, a transmitter-receiver according to a third embodiment will be described with reference to FIGS. 6 to 10.

Figure 6:
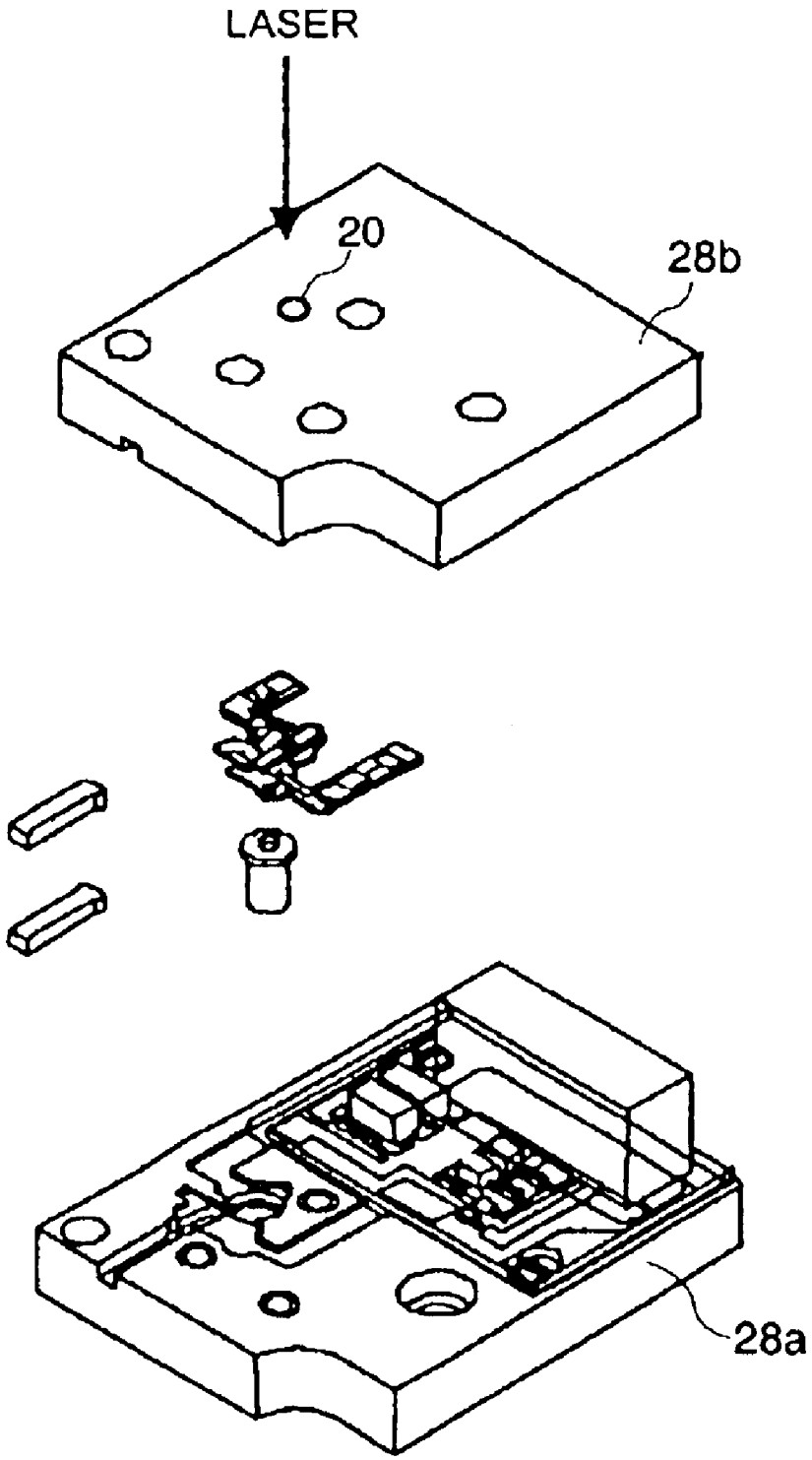
FIG. 6 is an exploded perspective view of an oscillator according to a third embodiment.

FIG. 6 is an exploded perspective view showing the configuration of the transmitter-receiver. Herein, reference numeral 28*a* denotes a lower conductor and reference numeral 28*b* denotes an upper conductor. A circuit forming a VCO is provided between the lower conductor 28*a* and the upper conductor 28*b*.

Figure 7:
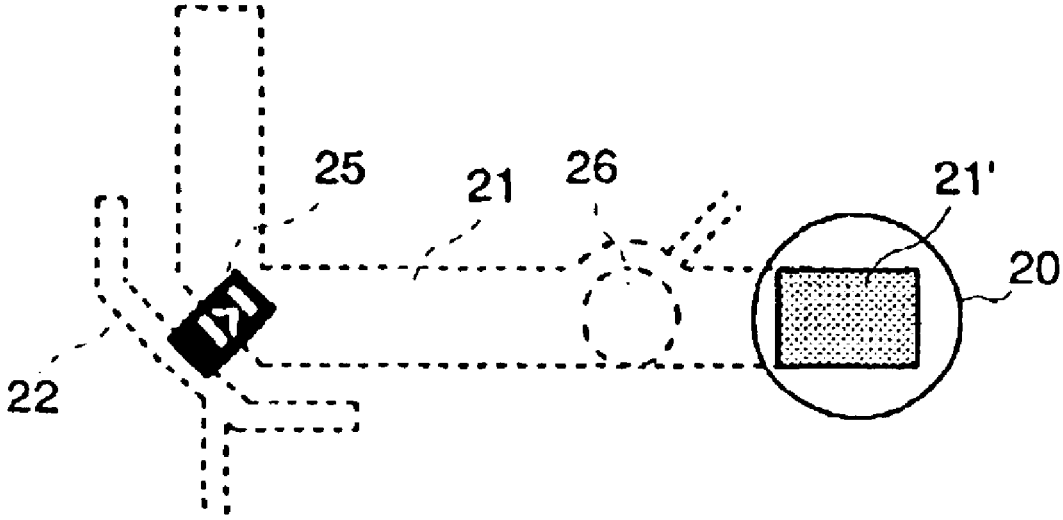
FIG. 7 is a plan view showing the main part of the oscillator.

FIG. 7 shows a circuit of the main part of the VCO. Herein, reference numeral 20 denotes a hole which is provided in the upper conductor 28*b* and which is used for laser trimming. Also, reference numeral 21 denotes a main line and reference numeral 22 denotes a sub line. A Gunn diode 26 is connected to a predetermined position of the main line 21. Also, a varactor diode 25 is connected between the main line 21 and the sub line 22. A portion indicated by reference numeral 21' is an end of the main line 21, the end being laser-trimmed. By laser-trimming the end through the hole 20, the resonance frequency according to the main line 21 is adjusted. Accordingly, characteristics of a control voltage to the varactor diode 25 to the oscillation frequency of the Gunn diode 26 are adjusted.

Figure 8:
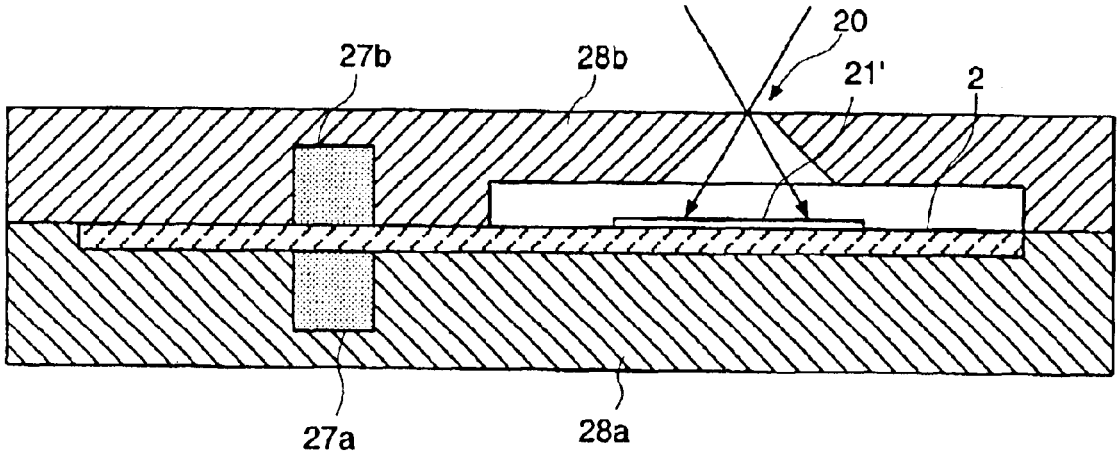
FIG. 8 is a cross-sectional view showing the main part of the oscillator.

FIG. 8 is a cross-sectional view of the oscillator taken along the line which passes the hole 20. Herein, the internal diameter of the hole 20 is small at the upper surface of the upper conductor 28*b* and gradually becomes larger with the depth. With this configuration, electromagnetic waves in a usable frequency band can be kept in a cutoff state and a laser beam can be radiated to the trimming portion 21' of the main line 21 on the substrate 2 at an angle. Accordingly, an increased trimming region can be obtained.

In FIG. 8, reference numerals 27*a* and 27*b* denote dielectric strips, which are sandwiched by the lower conductor 28*a* and the upper conductor 28*b*, so that a dielectric line is formed. This dielectric line is coupled to the main line (not shown in FIG. 8) provided on the substrate 2, so as to output an oscillation signal in a mode of the dielectric line.

Figure 9:
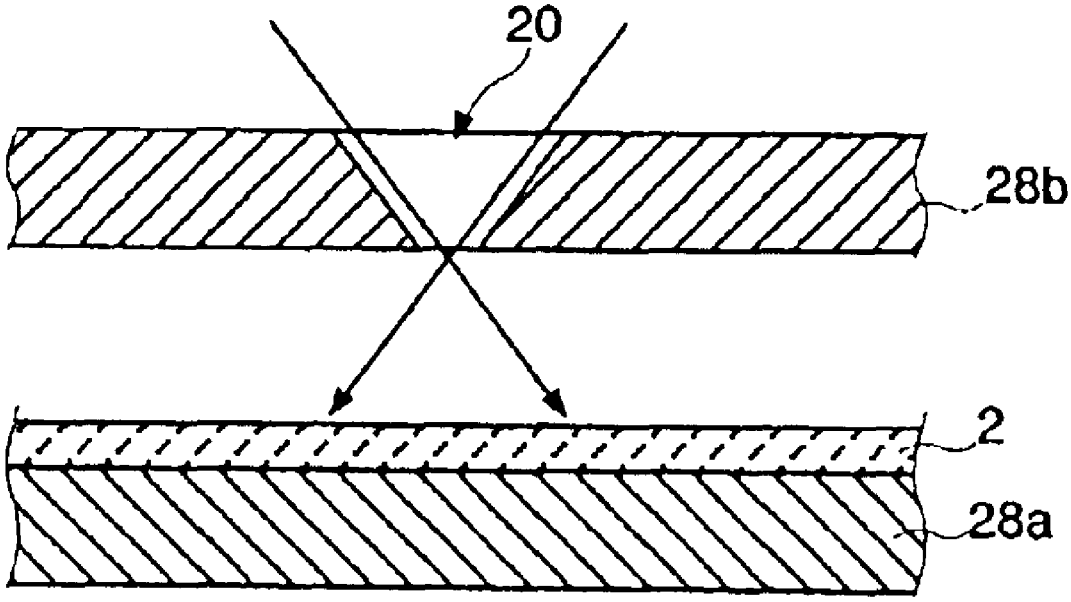
FIG. 9 is a partial cross-sectional view showing another example of the configuration of the oscillator.

FIG. 9 shows another example of the shape of the hole 20. In this example, the internal diameter of the hole 20 is large at the surface of the upper conductor 28*b*, and gradually becomes smaller with the depth. With this configuration, trimming can also be performed in a wide range, and also electromagnetic waves in a usable frequency band can be kept in a cutoff state.

Figure 10:
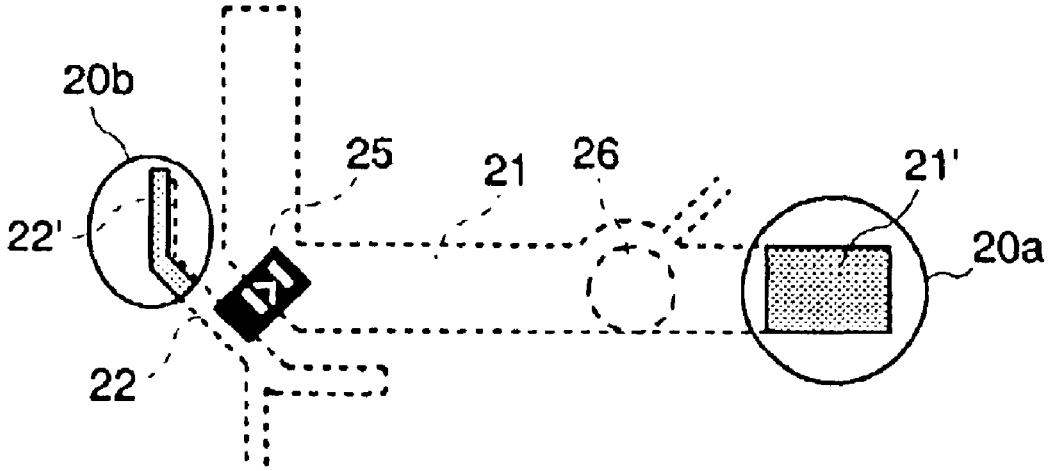
FIG. 10 is a partial plan view showing another example of the configuration of the oscillator.

FIG. 10 shows an example in which the configuration of the upper conductor 28*b* is changed. Herein, reference numeral 20*b* denotes a hole provided at a position corresponding to a trimming portion 22' of the sub line 22. Reference numeral 20*a* denotes a hole provided at a position corresponding to the trimming portion 21' of the main line 21, as in FIG. 7. In this way, the two holes 20*a* and 20*b* are provided in the upper conductor 28*b*. When one of the holes is used for radiating a laser beam, the other hole is used for removing unnecessary matter which is generated by laser trimming. For example, by radiating a laser beam through the hole 20*a*, the trimming portion 21' of the main line is trimmed. At the same time, unnecessary matter generated by the laser trimming is removed through the hole 20*b*. Alternatively, by radiating a laser beam through the hole 20*b*, the trimming portion 22' of the sub line is trimmed. At the same time, unnecessary matter generated by the laser trimming is removed through the hole 20*a*.

In this way, by providing a plurality of holes, unnecessary matter generated by laser trimming can be removed during laser trimming. Accordingly, vaporized metal does not adhere to the inside of the device, and a bad effect on a characteristic can be prevented. In particular, by providing two holes, the efficiency of removing unnecessary matter is enhanced.

Alternatively, in the first to third embodiments, the hole 20 may be hermetically sealed with resin or the like so as to avoid the effect of a corrosion gas or the like after adjusting a characteristic. With this configuration, the hole is originally formed so that electromagnetic waves in a usable frequency band can be kept in a cutoff state, and thus the resin used for hermetic sealing does not have an effect on the electrical characteristic.

Next, a millimeter-wave radar, which is an example of a transmitter-receiver according to a fourth embodiment, will be described with reference to FIG. 11.

Figure 11:
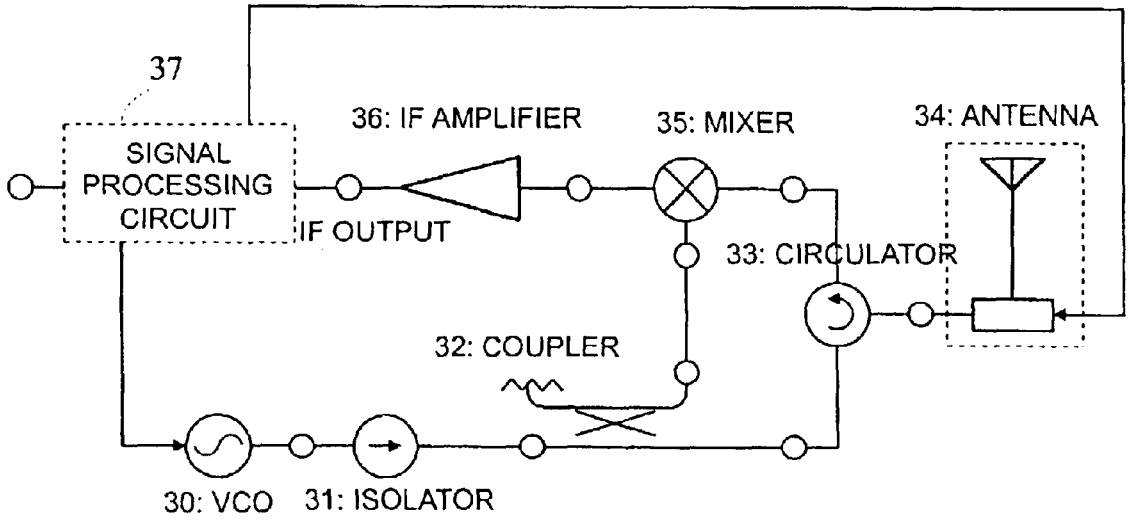
FIG. 11 is a block diagram showing the configuration of a transmitter-receiver according to a fourth embodiment.

In FIG. 11, the radar includes a VCO 30 having a Gunn diode and a varactor diode, in which the VCO according to the third embodiment is used. An isolator 31 prevents a reflected signal from returning to the VCO 30. A coupler 32 is a directional coupler including an NRD guide which takes part of a transmission signal as a local signal. A circulator 33 supplies the transmission signal to a primary radiator of an antenna 34 and also transmits a reception signal to a mixer 35. The mixer 35 mixes the reception signal and the local signal so as to output an intermediate frequency (IF) signal. An IF amplifier 36 amplifies the IF signal and supplies the IF signal to a signal processing circuit 37. The signal processing circuit 37 frequency-modulates the oscillation frequency of the VCO 30 into a triangular wave, so that the distance and the relative velocity to a target are detected based on the relationship between the modulated signal and the reception signal.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A high-frequency module comprising:

an element substrate including a dielectric or insulating substrate provided with a conductive film;

a conductive cover for covering the element substrate and defining a first hole therein, the first hole allowing a laser beam for laser trimming to pass therethrough to the element substrate, and an area of opening and a depth of the first hole being defined so that electromagnetic waves in a usable frequency are cut off in the first hole; and a second hole provided for removal of unnecessary matter generated by laser-trimming a predetermined portion of the element substrate, an area of opening and a depth of the second hole being defined so that electromagnetic waves in the usable frequency are cut off in the second hole.

2. The high-frequency module according to claim 1, wherein the first hole is formed so as to extend in a direction substantially parallel to the direction of a current flowing through the cover.

3. The high-frequency module according to claim 1, wherein the area of opening of the first hole is changed in accordance with the depth of the first hole so that the laser beam can be radiated to the element substrate at an angle.

4. The high-frequency module according to claim 2, wherein the area of opening of the first hole is changed in accordance with the depth of the first hole so that the laser beam can be radiated to the element substrate at an angle.

5. The high-frequency module according to claim 1, wherein a resonator is formed in the element substrate, the resonator including the substrate and the conductive film, and an oscillator is formed by coupling a negative resistor element to the resonator.

6. A transmitter-receiver comprising the high-frequency module according to claim 5; a transmitter circuit for transmitting an oscillation signal of the high-frequency module; and a circuit for converting a reception signal to an intermediate frequency signal.

7. A method of adjusting a characteristic of a high-frequency module comprising an element substrate including a dielectric or insulating substrate provided with a conductive film and a conductive cover for covering the element substrate, the method comprising:

trimming a predetermined portion of the element substrate by radiating a laser beam to the predetermined portion through a first hole in the cover, wherein an area of opening and a depth of the first hole is defined so that electromagnetic waves in a usable frequency are cut off in the first hole; and removing unnecessary matter generated by laser-trimming the predetermined portion of the element substrate through a second hole in the cover, and wherein an area of opening and a depth of the second hole is defined so that electromagnetic waves in the usable frequency are cut off in the second hole.

8. The method of adjusting a characteristic of a high-frequency module according to claim 7, the method further comprising radiating the laser beam to the element substrate at an angle.

9. The method adjusting a characteristic of a high-frequency module according to claim 7, the method further comprising:

forming a resonator in the element substrate, the resonator including the substrate and the conductive film; and forming an oscillator by coupling a negative resistor element to the resonator.

10. The method of adjusting a characteristic of a high-frequency module according to claim 9; method further comprising:

transmitting an oscillation signal of the high-frequency module; and converting a reception signal to an intermediate frequency signal.

* * * * *